US006553584B1

(12) United States Patent
Elnar

(10) Patent No.: US 6,553,584 B1
(45) Date of Patent: Apr. 29, 2003

(54) SPA COOLING FAN

(76) Inventor: Joseph G. Elnar, 12579 Canyon Wind Rd., Riverside, CA (US) 92503

( * ) Notice: Subject to any disclaimer, the term of this patent is extended or adjusted under 35 U.S.C. 154(b) by 0 days.

(21) Appl. No.: 10/075,982

(22) Filed: Mar. 27, 2002

(51) Int. Cl.[7] ..... A47K 3/00
(52) U.S. Cl. ..... 4/541.1
(58) Field of Search ..... 4/541.1–541.6

(56) References Cited

U.S. PATENT DOCUMENTS 5,794,280 A 8/1998 Hansen et al.
6,065,161 A * 5/2000 Mateina et al. ..... 4/541.6

* cited by examiner

*Primary Examiner*—Charles E. Phillips
(74) *Attorney, Agent, or Firm*—Edgar W. Averill, Jr.

(57) ABSTRACT

A spa cooling fan assembly mounted in the wall of a spa cabinet. The cabinet encloses a water circulating pump. A fan motor frame is secured over an opening in the spa cabinet wall and the fan is driven by a turbine. The turbine is driven by a flow of water from the water circulating pump so that when the water pump is running, the cooling fan also operates. A second cooling fan assembly may be mounted in a second opening in the spa cabinet wall. One cooling fan draws air out of the cabinet and the second cooling fan draws air from outside te cabinet into the cabinet. The result is that when the water pump is running, air is being circulated into the spa cabinet to keep the pump motor cool.

4 Claims, 4 Drawing Sheets

FIG. 4
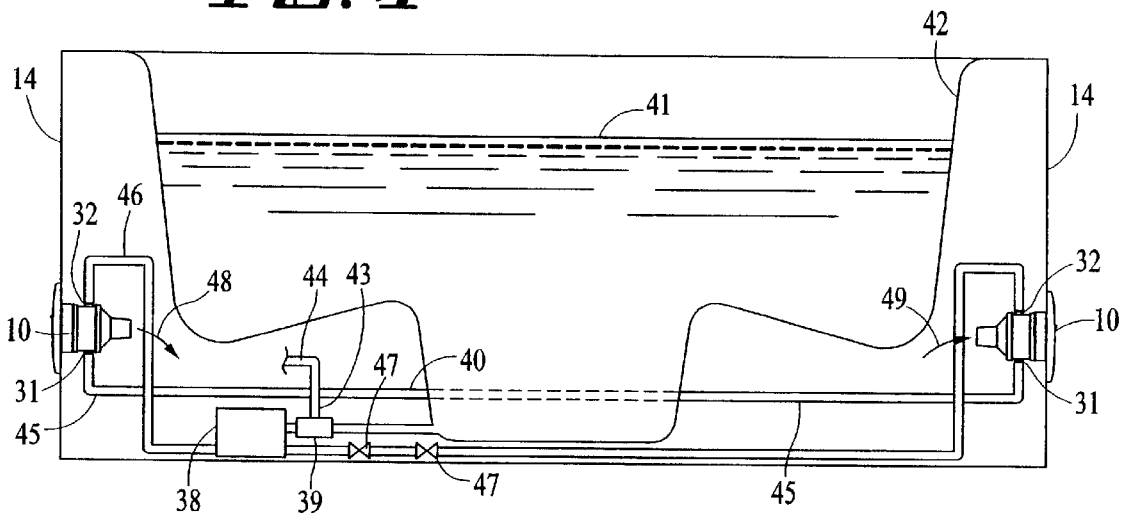
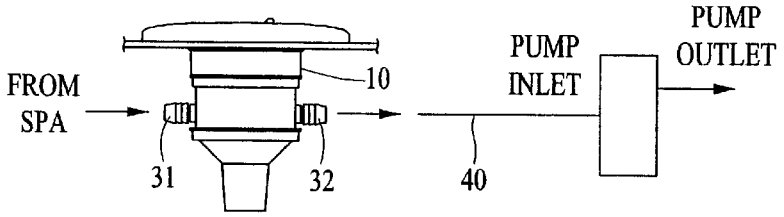
FIG. 5
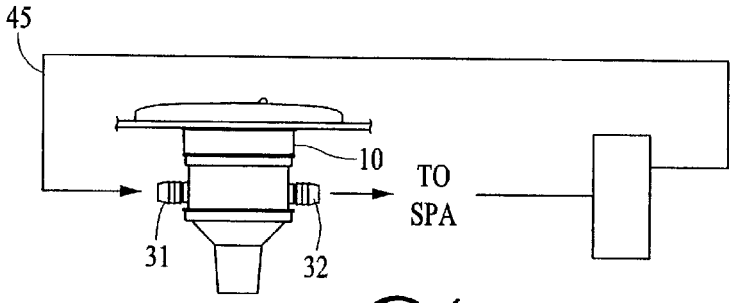
FIG. 6

SPA COOLING FAN

BACKGROUND OF THE INVENTION

The field of the invention is spas and the invention relates more particularly to the efficient operation of spas of the type which are mounted in a cabinet.

It is not uncommon for a motor to include a cooling fan extending from the motor shaft. One such motor is shown in U.S. Pat. No. 5,794,280. The typical spa is supported in a free-standing wooden cabinet, which also encloses the motor heater and if equipped, an air blower, together with the controls for such apparatus. Because a spa motor generates heat and because the cabinet is enclosed, it is often the case that temperature within the cabinet will rise to the extent that the pump motor and the spa electronics are required to operate at a temperature above that which is optimum for motor or component life. The circulation of hot air, such as that accomplished when a fan is attached to the motor output shaft, does a less than adequate job at keeping the motor cool since the air surrounding the motor is not cool.

BRIEF SUMMARY OF THE INVENTION

It is an object of the present invention to provide apparatus which will cool a pump motor or spa electronics by cooling the ambient temperature within a spa cabinet in which the motor is contained.

The present invention is for a spa cooling assembly mounted in the wall of a spa cabinet. The spa cabinet includes a water circulating pump and the cabinet has a cabinet wall with an opening therein. A fan motor frame is secured within the spa cabinet. An airflow passageway is formed within the fan motor frame and the airflow passageway has an air exit opening and an air entrance opening. A plurality of louvers are held in the air flow passageway and positioned across the airflow passageway between the exit opening and the entrance opening. Means are provided for opening and closing the louvers to close or open the flow of air. A turbine water inlet is held by the fan motor frame and the inlet is fed by the water circulating pump. A turbine is also held by the fan motor frame and has an inlet and an outlet. The fan is connected to a turbine output shaft and extends over a majority of the airflow passageway whereby when the water circulating pump is operating, water enters the turbine water inlet, passes over the plurality of turbine blades, and exits the turbine water outlet, causing the fan to turn and causing air to pass through the opening into the spa wall when the louvers are in an open configuration.

BRIEF DESCRIPTION OF THE DRAWINGS

FIG. 4 is a schematic view of a spa, including a pair of spa cooling assemblies of the present invention.

FIG. 5 is a schematic view of an alternate piping assembly of the spa cooling assembly of FIG. 4.

FIG. 6 is a schematic view of an alternate piping assembly of the spa cooling assembly of FIG. 4.

DESCRIPTION OF THE PREFERRED EMBODIMENTS

Figure 1:
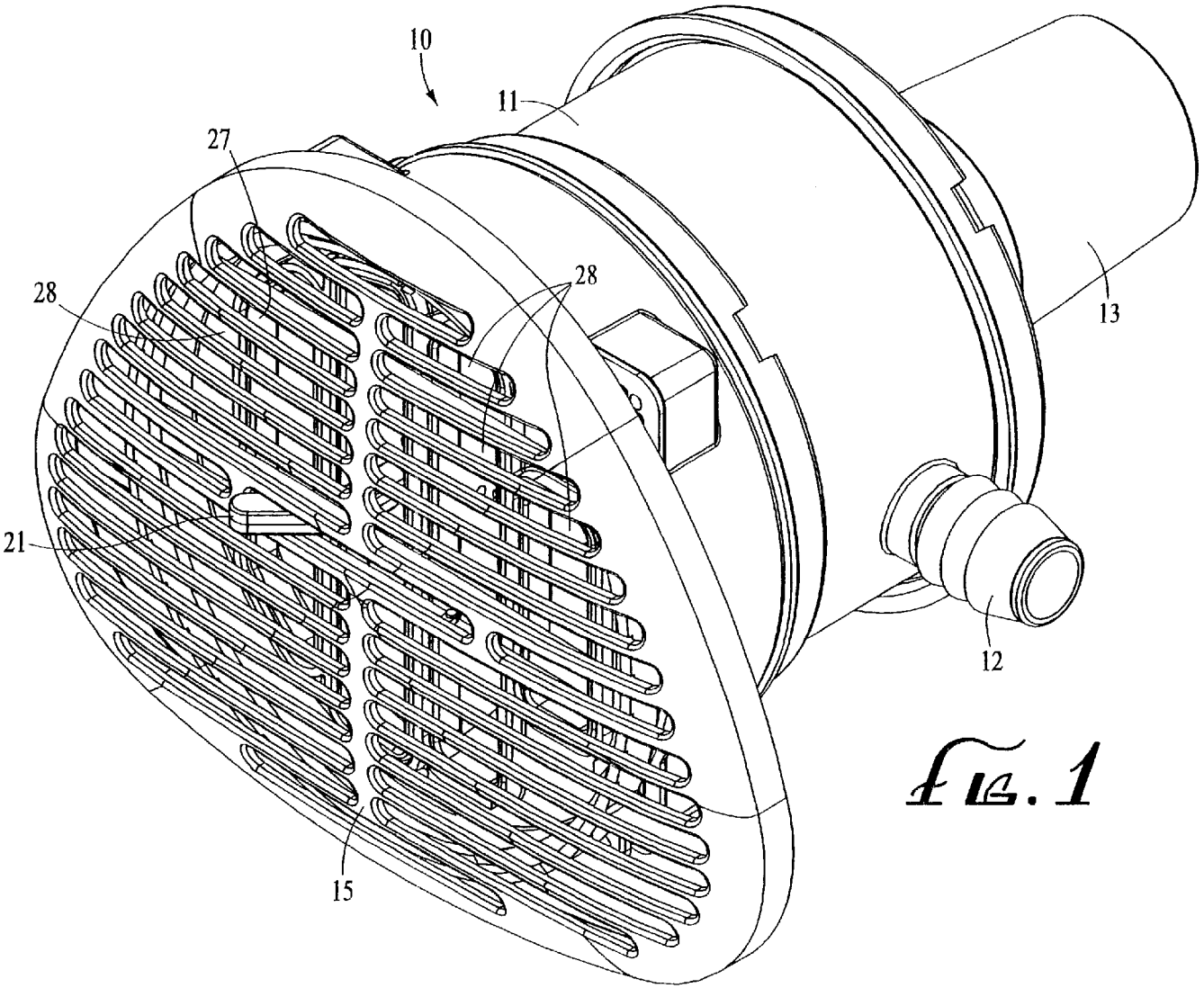
FIG. 1 is a perspective view of the spa cooling fan assembly of the present invention.

The spa cooling fan of the present invention is shown in perspective view in FIG. 1 and indicated generally by reference character 10. Spa cooling 10 has a fan motor frame 11. Frame 11 supports a water inlet 12. Frame 11 also supports an air inlet or outlet duct 13.

Figure 2:
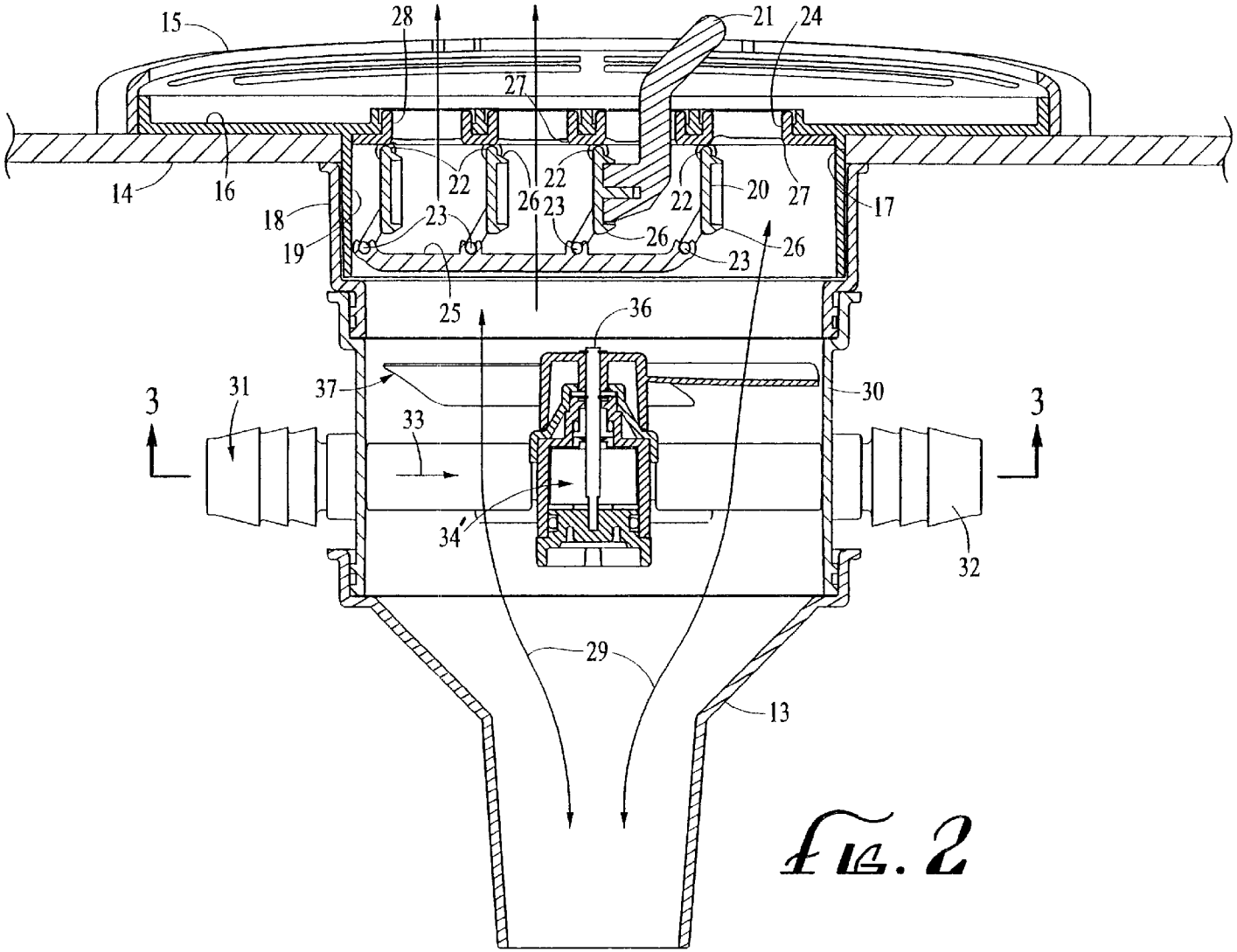
FIG. 2 is a cross-sectional view thereof.

The fan motor frame 11 is supported by attachment to a spa cabinet wall as shown in FIGS. 2 and 4. The fan motor may be supported in a plastic enclosure held within a foam filling in the spa cabinet. The spa cabinet wall is indicated by reference character 14. A grill 15 is snapped over a grill frame 16 which passes through an opening 17 in spa cabinet wall 14. A coupling 18 is glued to outer louver frame 19 which is connected to grill frame 16.

A plurality of louvers are operated by handle 21. Louvers 20 pivot from outer pivot points 22 which are secured to inner louver frame 24, affixed to outer louver frame 19. Louvers 20 also pivot from inner pivot points 23, which are snapped into inner pivot arm 25. In this way, the moving of handle 21 rotates the louvers so that their angled faces 26 seal against the bottom walls 27 of louver openings 28. In this way, the airflow along airflow passageway 29 is stopped, even though the fan may be operating.

Figure 3:
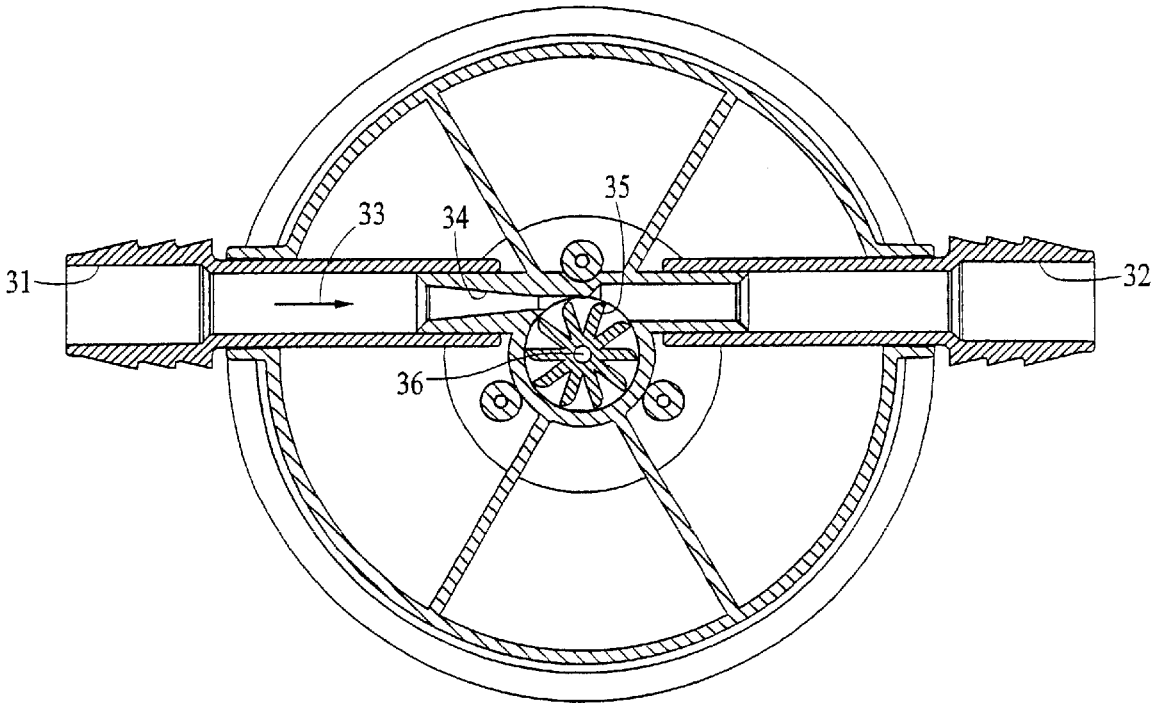
FIG. 3 is a cross-sectional view taken along line 3—3 of FIG. 2.

The turbine and fan assembly is shown best in FIG. 2 where fan motor frame is indicated by reference character 30. Frame 30 holds turbine water inlet 31 and turbine water outlet 32. A water flow path 33 causes water to flow past turbine 34'. As shown best in FIG. 3, water flowing from inlet 31 passes through nozzle 34 and impacts turbine blades 35, causing turbine output shaft 36 to turn. As shown in FIG. 2, turbine output shaft 36 is connected to fan 37. Although it is shown directly attached in FIG. 2, it man, instead, be attached by a flexible cable or other drive means. Fan 37 can be configured either to draw air out from the spa cabinet and out through grill 15, or alternatively, a reverse fan can be connected to output shaft 36, which will draw air in through grill 15 and feed it into the interior of the spa cabinet. Air flows in or out of air inlet or outlet duct 13, depending upon the configuration of fan 37.

Turning now to the spa cabinet cooling process, reference is made to FIG. 4. One or more cooling assemblies 10 may be affixed over openings in spa cabinet wall 14. A pump motor 38 drives water circulating pump 39, which is fed through inlet 40 from the water 41 in spa 42. The pump outlet 43 has a line 44 which feeds the spa jets and other spa plumbing. Outlet line 43 is also connected to fan turbine water inlet 45 to drive the fan turbine within the spa cooling assembly 10. Water is returned through fan turbine water outlet line 46, which is connected to inlet line 40. Valves 47 may be provided to permit the control of water flow to the spa cooling fan assemblies 10. Preferably, in a two fan assembly, such as that shown in FIG. 4, one of the assemblies would be equipped with a fan which drew air in from the exterior of the cabinet, as indicated by arrow 48, and the other configured to draw air out of the spa cabinet, as indicated by reference character 49. This provides a highly efficient air flow for cooling the interior of cabinet 14.

The spa cooling assembly 10 can be piped so that the turbine water inlet is fed from a water line from the spa water 41 and the turbine water outlet 42 could be connected to the pump inlet line 40. Alternatively, as shown in FIG. 6, the fan turbine inlet water 31 can be connected to the pump outlet line 45 and rather than returning to the pump inlet, outlet 32 could feed a line which returns the water to water 41 within spa 42. The important feature is that the fan operate when motor 38 is operating.

While the term "water" has been used herein, it is also intended to included other fluids, such as air, if it is desired to cool the air blower motor rather than the water circulating motor. Needless to say, air flow is capable of operating turbine 34 in place of water flow.

The result is a highly efficient cooling system which is trouble-free in operation, since it automatically operates when the pump motor needs cooling. If the weather is quite cool, the fan air flow can readily be stopped by closing louvers 20.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A spa cooling fan assembly having an exhaust/inlet fitting mounted in a wall of a spa cabinet, a spa cabinet wall having an opening therein, said spa cabinet enclosing a water circulating pump, said spa cooling fan and spa cabinet wall comprising:

a fan motor frame secured within an interior of said spa cabinet wall;

an air flow passageway formed within said fan motor frame, said air flow passageway having an air exit opening and an air entrance opening;

a plurality of louvers held by said exhaust/inlet fitting, said plurality of louvers including means for closing and opening said plurality of louvers to open or close the flow of air through said exhaust/inlet fitting;

a turbine water inlet held by said fan motor frame, said turbine water inlet being connected to a water inlet flow path and to a water outlet line of said water circulating pump;

a turbine held by said fan motor frame, said turbine having a turbine inlet connected to said turbine water inlet and said turbine having a turbine outlet and said water flow path passing a plurality of turbine blades said turbine having an output shaft coaxially mounted with respect to said air flow passageway;

a turbine water outlet held by said fan motor frame, said turbine water outlet being connected to said water flow path and said water outlet being connected to a water inlet of said water circulating pump; and a fan connected to said turbine output shaft, said fan extending over a majority of said air flow passageway, whereby when said water circulating pump is operating, water enters said turbine water inlet, passes over said plurality of turbine blades and exits said turbine water outlet causing said fan to turn and causes air to pass through said exhaust/inlet fitting in said spa wall when said louvers are in an open configuration in said air flow passageway.

2. The spa cooling fan assembly of claim 1 wherein said fan directs air out of said exhaust/inlet fitting past said plurality of louvers.

3. The spa cooling fan assembly of claim 1 wherein said plurality of louvers can be moved to a closed position where essentially no air can pass by said plurality of louvers.

4. The spa cooling fan assembly of claim 1 further including a second cooling fan assembly having the same elements as the cooling fan assembly of claim 1 and having an exhaust/inlet fitting mounted over a second opening in said wall of said spa cabinet, one of said cooling fan assemblies moving air out of said spa cabinet and the second cooling fan assembly moving air into said spa cabinet.

* * * * *